US012092337B2

(12) United States Patent
Farrel et al.

(10) Patent No.: US 12,092,337 B2
(45) Date of Patent: Sep. 17, 2024

(54) HOUSEHOLD APPLIANCE AND HANDLE THEREOF

(71) Applicant: Haier US Appliance Solutions, Inc., Wilmington, DE (US)

(72) Inventors: Caleb Farrel, Jeffersonville, IN (US); Joshua Adam Mayne, Charlestown, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 509 days.

(21) Appl. No.: 17/471,536

(22) Filed: Sep. 10, 2021

(65) Prior Publication Data

US 2023/0085049 A1 Mar. 16, 2023

(51) Int. Cl.
*F24C 15/02* (2006.01)

(52) U.S. Cl.
CPC ..... *F24C 15/024* (2013.01)

(58) Field of Classification Search
CPC ..... F24C 15/024
USPC ..... 126/198, 273 R, 273 A
See application file for complete search history.

(56) References Cited

U.S. PATENT DOCUMENTS

| | | | | |
|---|---|---|---|---|
| 4,383,519 | A * | 5/1983 | Katona | F24C 15/024 126/190 |
| 8,303,726 | B2 | 11/2012 | Beaudet | |
| 2014/0139095 | A1* | 5/2014 | Lambkin | F23M 11/04 49/504 |
| 2020/0149746 | A1 | 5/2020 | Yeun | |

FOREIGN PATENT DOCUMENTS

| | | | |
|---|---|---|---|
| DE | 102015102082 | A1 | 8/2016 |
| JP | H02230026 | A | 9/1990 |
| JP | 2004232284 | A | 8/2004 |
| KR | 100272355 | B1 | 12/2000 |

* cited by examiner

*Primary Examiner* — Vivek K Shirsat
(74) *Attorney, Agent, or Firm* — Dority & Manning, P.A.

(57) ABSTRACT

An oven appliance may include a cabinet, a door, and a restrictor plate. The cabinet may include a top panel and a bottom panel. The cabinet may define an internal chamber between the top panel and the bottom panel. The door may be mounted on the cabinet to selectively restrict access to the internal chamber in a closed position. The door may extend along the vertical direction in the closed position between a top lip and a bottom lip. The handle may be provided on the door proximal to the top lip. The handle may define an upper surface directed away from the bottom lip, the upper surface being a complementary match to the underside surface of the top panel.

20 Claims, 10 Drawing Sheets

HOUSEHOLD APPLIANCE AND HANDLE THEREOF

FIELD OF THE INVENTION

The subject matter of the present disclosure relates generally to household appliances, such as dishwasher or oven appliances, and more specifically to a handle for household appliances.

BACKGROUND OF THE INVENTION

Household appliances generally define one or more enclosures or cabinets for heating, cooling, washing, or drying; at least one control panel; and at least one door that allows a user to open and close the one or more enclosures or cabinets. Each door may have a handle to facilitate the user opening and closing the at least one door of the household appliance to place articles into the one or more enclosures or cabinets. The doors are sometimes made of multiple parts to better insulate the inner cavity to allow for proper temperature distribution, airflow, or waterproofing during use. A door may further include an outer panel and inner panel. The handle of the door may typically be mounted to the front panel of the door, and often is configured as a lateral bar to allow a towel or other useful article to be stored thereon. An inner hinge assembly may allow the door to open and close.

Integrated handles are sometimes formed as a part of the front panel of the door. Such handles may have desirable features such as reduced profiles extending from the door of the appliance, or smaller profiles generally. A sleek, pleasing appearance also may result from integrated handles. Such handles may include pocket handles, which form a sort of pocket in the front panel of the door of the household appliance.

There are issues, however, with existing integrated handles. For example, such handles are not readily switched out for repairs, as the entire front panel generally needs to be replaced to replace the handle. Additionally, replacement of a typical integrated handle may be especially difficult, as the whole door, which may be of significant weight, must usually be removed from the household appliance to complete the repair.

Furthermore, changes to the aesthetic of a household appliance may be more difficult with an integrated handle when compared with a bar handle. Modular appliances, or appliances that are easily changed from one style to another, generally use a bar handle, as such can be readily changed out without the need to remove the door of the household appliance. Such is useful in the manufacture as well as repair of these household appliances, as the bar handle is readily changed from one style to another. An integrated handle, however, generally needs to change the entire front panel in order to make the change. This may require dismantling the different parts of the door including removal of the bottom panel, side panels, and top cover to complete the replacement. Careful placement of the door may also be required during replacement due to the glass panes often housed within the door. Additionally, more material is generally required to make a replacement front panel with integrated handle than to replace a bar handle. Thus, it is often more difficult and costly to change the outward appearance or style of the household appliance if it has an integrated handle than if it has a bar handle.

Accordingly, a household appliance with a door handle capable of having one or more beneficial features of an integrated handle without the mechanical difficulties associated with the integrated handle would be useful. For example, a household appliance with a door having a handle with a reduced profile that was removable from the appliance without necessitating the removal of the front door from the appliance would be beneficial. Additionally or alternatively, a handle that could readily have its outward appearance or style changed, such as exchanging a door handle without having to remove or partially dismantle the door of the household appliance, may be desirable.

BRIEF DESCRIPTION OF THE INVENTION

Additional aspects and advantages of the invention will be set forth in part in the following description, or may be apparent from the description, or may be learned through practice of the invention.

In one exemplary aspect of the present disclosure, a household appliance is provided. The household appliance may include a cabinet, a door, and a handle. The cabinet may include a top panel. The cabinet may define an internal chamber between a top and a bottom. The top panel may define an underside surface directed downward above the internal chamber. The door may be mounted on the cabinet below the top panel to selectively restrict access to the internal chamber in a closed position. The door may extend along a vertical direction in the closed position between a top lip and a bottom lip. The handle may be provided on the door proximal to the top lip. The handle may define an upper surface directed away from the top lip. The upper surface may be a complementary match to the underside surface of the top panel.

In another exemplary aspect of the present disclosure, a household appliance is provided. The household appliance may include a cabinet, a door, and a handle. The cabinet may include a top panel. The cabinet may define an internal chamber between a top and a bottom. The top panel may define an underside surface directed downward above the internal chamber. The door may be mounted on the cabinet below the top panel to selectively restrict access to the internal chamber in a closed position. The door may extend along a vertical direction between a top lip and a bottom lip and along a transverse direction between a front surface and a rear surface in the closed position. The handle may be provided on the door proximal to the top lip. The handle may define an upper surface directed away from the top lip. The upper surface may be a complementary match to the underside surface of the top panel. The handle may extend forward from the front surface of the door at an acute angle with respect to the vertical direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Use of the same of similar reference numerals in the figures denotes the same or similar features unless the context indicates otherwise.

DETAILED DESCRIPTION OF THE INVENTION

Figure 1:
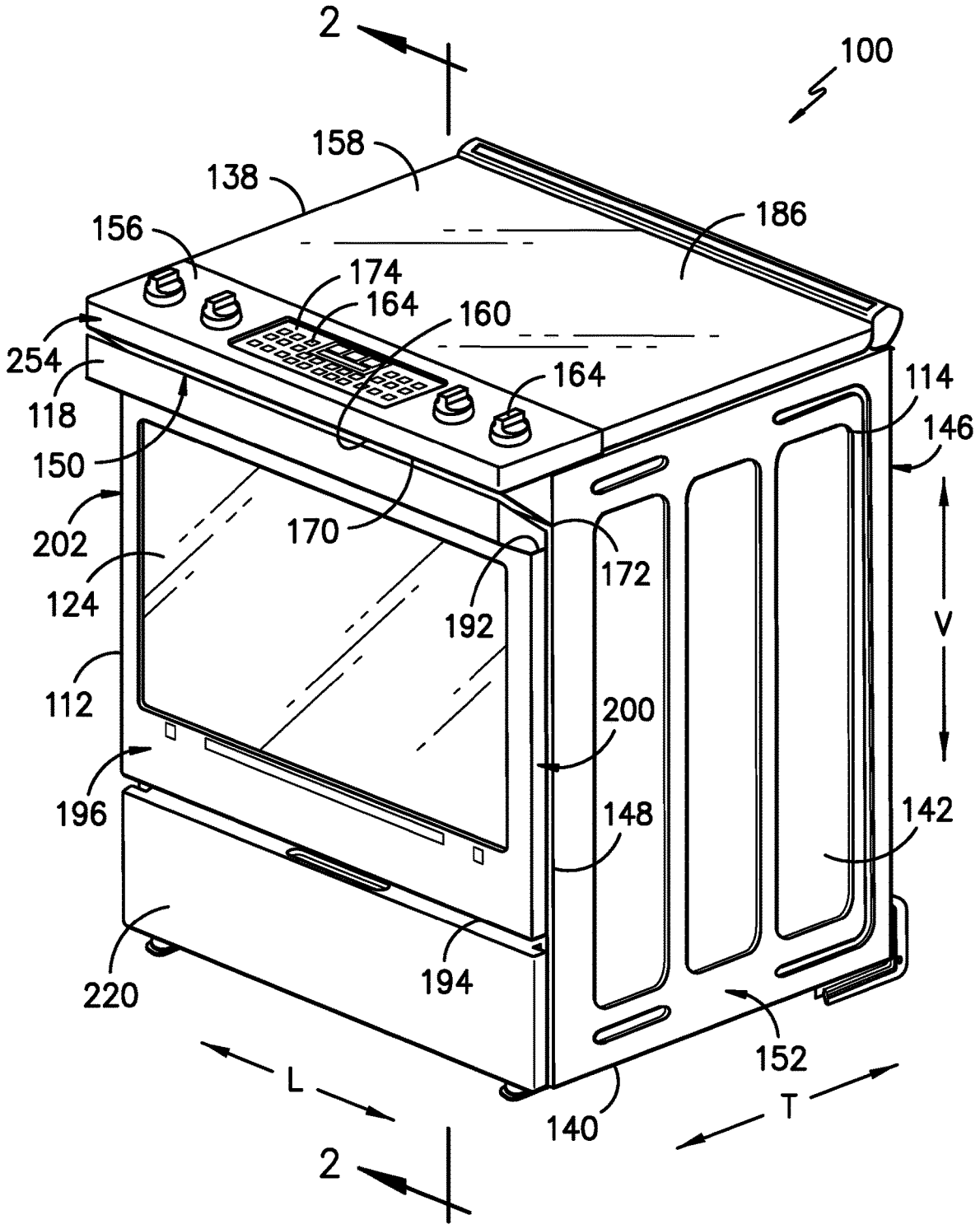
FIG. 1 provides a perspective view of an exemplary embodiment of the household appliance of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. Terms such as "inner" and "outer" refer to relative directions with respect to the interior and exterior of the oven appliance, and in particular the oven chamber(s) defined therein. For example, "inner" or "inward" refers to the direction towards the interior of the oven appliance. Terms such as "left," "right," "front," "back," "top," or "bottom" are used with reference to the perspective of a user accessing the oven appliance (e.g., when the door is in the closed position). For example, a user stands in front of the oven appliance to open a door and reaches into the internal chamber(s) to access items therein.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

Figure 2:
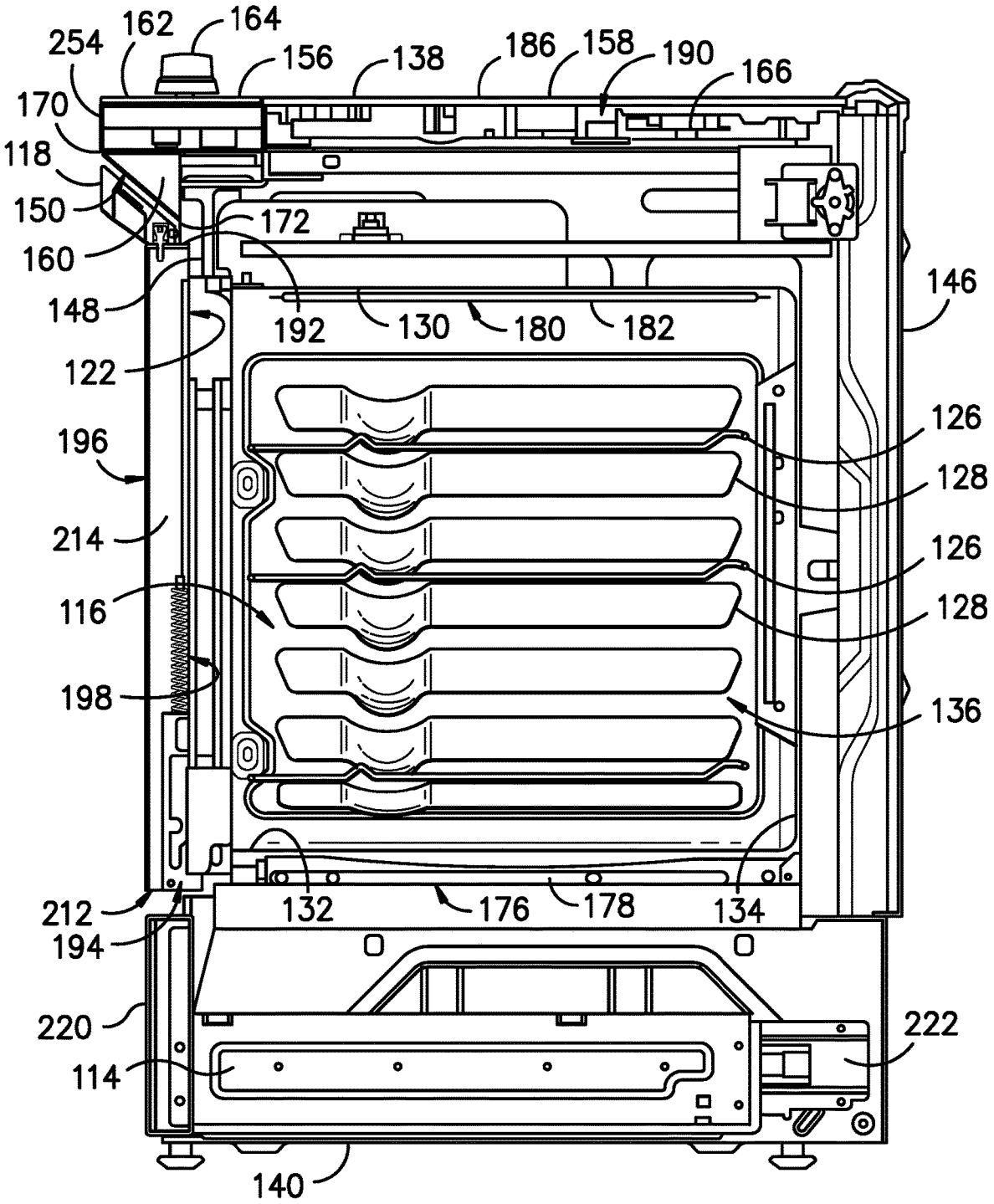
FIG. 2 provides a side, cross sectional view of the exemplary household appliance of FIG. 1.

Turning to the figures, FIGS. 1 and 2 depict an exemplary household appliance (e.g., oven appliance 100) that may be configured in accordance with aspects of the present disclosure. FIG. 1 provides a perspective view of an oven appliance 100 according to exemplary embodiments of the present disclosure. FIG. 2 provides a cross sectional elevation view of oven appliance 100 taken along the 2-2 line of FIG. 1. As shown, oven appliance 100 defines a vertical direction V, a lateral direction L, and a transverse direction T. The vertical direction V, lateral direction L, and transverse direction T are mutually perpendicular and form an orthogonal direction system (e.g., generally discussed or referenced to oven appliance 100 having the door 112 in the closed state or position). The household appliance extends along the lateral direction between a pair of opposing sides, extends along the transverse direction between a front and a back, and extends along a vertical direction between a top and a bottom. As will be understood by those skilled in the art, oven appliance 100 is provided by way of example only, and the present subject matter may be used in any suitable household appliance. Thus, the present subject matter may be used with other oven appliances having different configurations, such as wall ovens, electric ovens, gas ovens, etc. The present subject matter may further be used with other household appliances such as microwave ovens, washing machine appliances, dryer appliances, dishwashing appliances, refrigerator appliances, etc. Oven appliance 100 will be described below, with the understanding that other embodiments may include or be provided as another suitable household appliance (e.g., defining an internal chamber).

Oven appliance 100 includes a cabinet 114 with an internal chamber 116 disposed or defined within cabinet 114. Internal chamber 116 is also referred to as internal chamber 116 as used herein and may be insulated. In some embodiments, internal chamber 116 is configured for the receipt of one or more food items to be cooked. The cabinet 114 defines the internal chamber 116 between the top wall 130 and the bottom wall 132. Oven appliance 100 includes a door 112 rotatably mounted to cabinet 114 (e.g., with a hinge). A handle 118 is mounted to door 112 and assists a user with opening and closing door 112 in order to access internal chamber 116 (as will be described in greater detail below). For example, a user can pull on handle 118 to open or close door 112 and access internal chamber 116 through the opening. As would be understood, one or more internal heating elements (e.g., baking heating elements 178 or broiling heating elements 182) may be provided within internal chamber 116 to cook or otherwise heat items therein.

In this regard, as used herein, the terms "cabinet," "housing," and the like are generally intended to refer to an outer frame or support structure for appliance (e.g., including any suitable number, type, and configuration of support structures formed from any suitable materials, such as a system of elongated support members, a plurality of interconnected panels, or some combination thereof). It should be appreciated that cabinet 114 does not necessarily require an enclosure and may simply include open structure supporting various elements of appliance. By contrast, cabinet 114 may enclose some or all portions of an interior of cabinet 114. It should be appreciated that cabinet 114 may have any suitable size, shape, and configuration while remaining within the scope of the present subject matter.

Oven appliance 100 can include a seal 122 (e.g., gasket) between door 112 and cabinet 114 that assists with maintaining heat and cooking fumes within internal chamber 116 when door 112 is closed as shown. Door 112 may include a window 124, constructed for example from multiple parallel glass panes to provide for viewing the contents of internal chamber 116 when door 112 is closed and assist with insulating internal chamber 116. A baking rack 126 may be positioned in internal chamber 116 for the receipt of food items or utensils containing food items. The baking rack 126 may be slidably received onto embossed ribs 128 or sliding rails such that the baking rack 126 may be conveniently moved into and out of internal chamber 116 when door 112 is open.

Generally, various sidewalls define internal chamber 116. For example, internal chamber 116 includes a top wall 130 and a bottom wall 132 that are spaced apart along the vertical direction V. Left and right sidewalls extend between top wall 130 and bottom wall 132, and are spaced apart along the lateral direction L. A rear wall 134 may additionally extend between the top wall 130 and bottom wall 132 as well as between the left and right sidewalls, and is spaced apart from door 112 along the transverse direction T. In this manner, when door 112 is in the closed position, a cavity 136 (also referred to as "cooking cavity 136" herein) is defined by door 112 and top wall 130, bottom wall 132, sidewalls, rear wall 134 of internal chamber 116.

Cabinet and Panels

As further illustrated, cabinet 114 includes multiple panels that enclose internal chamber 116. For example, cabinet 114 includes a top panel 138 and a bottom panel 140 that are spaced apart along the vertical direction V. Left panel 142 and right panel 144 (as defined according to the view as shown in FIG. 1) extend between top panel 138 and bottom panel 140, and are spaced apart along the lateral direction L. A rear panel 146 may additionally extend between top panel 138 and bottom panel 140 as well as between left panel 142 and right panel 144, and is spaced apart from door 112 along the transverse direction T. When door 112 is in the closed position, door 112 (e.g., at rear surface 198) may sit flush with a forward panel 148 or portion of cabinet 114. As shown, forward panel 148 extends between top panel 138 and bottom panel 140 to generally define the opening to internal chamber 116.

The top panel 138 defines an underside surface 150 directed downward above the internal chamber 116. In some embodiments, underside surface 150 of the top panel 138 extends the lateral length of the cabinet 114. Specifically, underside surface 150 may extend (e.g., continuously) from one lateral side 152 of the cabinet 114 to the other (i.e., opposite) lateral side 154 of the cabinet 114. In additional or alternative embodiments, the top panel 138 extends beyond the transverse position (i.e., transverse extreme) of the forward panel 148 The underside surface 150 of the top panel 138 may be the portion of the top panel 138 closest to the floor or the portion of the top panel 138 generally facing the door 112 (e.g., while extending beyond the forward panel 148). The underside surface 150 of the top panel 138 may extend non-orthogonally to the forward panel 148. For instance, the underside surface 150 of the top panel 138 may face forward at a non-orthogonal angle relative to the transverse direction.

In some examples, the top panel 138 includes a front panel 156, cooktop panel 158, or an underside panel 160. The front panel 156 and underside panel 160 may attach to each other such that the front panel 156 is vertically above the underside panel 160. In some such embodiments, the underside surface 150 of the top panel 138 can be characterized as the underside surface 150 of the underside panel 160. The front panel 156 may be located transversely forward of the cooktop panel 158. The front panel 156 may house a controller 162 or controls 164, as described in more detail below. Additionally or alternatively, the cooktop panel 158 may be proximal to a plurality of heating assemblies 166, as described in more detail below.

In some examples, the top panel 138 includes a cooktop panel 158 and an underside panel 160, with the underside panel 160 attached to the cooktop panel 158 at a forward position (e.g., vertically below the cooktop panel 158). As noted above, the underside surface 150 of the top panel 138 may be the underside surface 150 of the underside panel 160. In some examples, the top panel 138 includes a cooktop panel 158 and a front panel 156, with the front panel 156 attached to the cooktop panel 158 transversely forward to the cooktop panel 158.

In certain embodiments, the underside surface 150 of the top panel 138 extends forward from a forward panel 148 of the cabinet 114, forming an underside angle 168 (e.g., with or with respect to the vertical direction V). For instance, the underside angle 168 may be an acute angle with respect to the vertical direction. The underside panel 160 may further include a distal underside edge 170 transversely forward the rest of the underside surface 150 and a proximal underside edge 172 attached to the forward panel 148. The proximal underside edge 172 may be vertically lower compared to the distal underside edge 170 of the underside surface 150 to form the underside angle 168.

The top panel 138 may further include, or be formed as, a control panel 174 disposed above the underside surface 150. The control panel 174 may further be on a front panel 156 of the top panel 138 and may face vertically upwards.

In the included figures, panels of cabinet 114 are single ply sheet metal panels, but one skilled in the art will appreciate that any suitably rigid panel may be used while remaining within the scope of the present subject matter. For example, according to exemplary embodiments, panels may be constructed from a suitably rigid and thermally resistant plastic. Additionally or alternatively, each panel may include multiple layers made from the same or different materials and may be formed in any suitable shape.

A lower heating assembly (e.g., bake heating assembly 176) may be positioned in oven appliance 100, and may include one or more heating elements (e.g., bake heating elements 178). Bake heating elements 178 may be disposed within internal chamber 116, such as adjacent bottom wall 132. In exemplary embodiments as illustrated, the bake heating elements 178 are electric heating elements, as is generally understood. Alternatively, the bake heating elements 178 may be gas burners or other suitable heating elements having other suitable heating sources. Bake heating elements 178 may generally be used to heat internal chamber 116 for both cooking and cleaning of oven appliance 100.

Additionally or alternatively, an upper heating assembly (e.g., broil heating assembly 180) may be positioned in oven appliance 100, and may include one or more upper heating elements (e.g., broil heating elements 182). Broil heating elements 182 may be disposed within internal chamber 116, such as adjacent top wall 130. In exemplary embodiments as illustrated, the broil heating elements 182 are electric heating elements, as is generally understood. Alternatively, the broil heating elements 182 may be gas burners or other suitable heating elements having other suitable heating sources. Broil heating elements 182 may additionally be used to heat internal chamber 116 for both cooking and cleaning of oven appliance 100.

In some embodiments, oven appliance 100 includes a cooktop 186 positioned at top panel 138 of oven appliance 100. In such embodiments, top panel 138 may be a generally planar member having an upward surface that is perpendicular to the vertical direction V. In particular, top panel 138 may be formed from glass, glass ceramic, metal, or another suitable material. A plurality of heating assemblies (e.g., cooktop heating assemblies 166) may be mounted to or otherwise positioned on top panel 138. In some embodiments, cooktop heating assemblies 166 are positioned above internal chamber 116 of cabinet 114 (i.e., higher relative to the vertical direction V). Optionally, cooktop heating assemblies 166 may extend between internal chamber 116 and top panel 138, within an open region 190 that is defined between top panel 138 and the internal chamber 116. Cooking utensils, such as pots, pans, griddles, etc., may be placed on top panel 138 and heated with heating assemblies 166 during operation of the cooktop 186. In FIGS. 1 and 2, cooktop heating assemblies 166 are shown as radiant heating elements mounted below top panel 138. However, in alternative example embodiments, cooktop heating assemblies 166 may be any suitable heating assembly, such as gas burner elements, resistive heating elements, induction heating elements, or other suitable heating elements.

The door 112 is mounted on the cabinet 114 below the top panel 138 to selectively restrict access to the internal chamber 116 in a closed position. As may be seen in FIG. 2, door 112 extends between a top lip 192 and a bottom lip 194 (e.g., along the vertical direction V when door 112 is in the closed position). Door 112 may further extend between a front surface 196 and a rear surface 198 (e.g., along the transverse direction T when the door 112 is in the closed position). The door 112 further extends laterally between a pair of opposing surfaces 200, 202. A door thickness 208 is defined as the transverse distance between the front surface 196 and the rear surface 198 (e.g., when the door 112 is in a closed position). Thus, the door 112 defines a door thickness 208 between a front surface 196 and a rear surface 198 of the door 112. As will be described in greater detail below, a handle 118 may be provided on the door 112 proximal to the top lip 192, the handle 118 defining an upper surface 210 directed away from the top lip 192. The upper surface 210 may be a complementary match to the underside surface 150 of the top panel 138. The handle 118 may further define the upper surface 210 directed vertically upward and away from the top lip 192.

In some embodiments, oven range appliance also includes features for limiting or reducing heat transfer within door 112 (e.g., along the transverse direction T during operation of oven range appliance). In some embodiments, door 112 defines an intake 212, a conduit or channel 214, and an exhaust 216. In some embodiments, intake 212 of door 112 is positioned at or adjacent bottom lip 194 of door 112 and permits air therethrough. Conversely, exhaust 216 of door 112 is positioned at or adjacent top lip 192 of door 112. Channel extends between intake 212 of door 112 and exhaust 216 of door 112 (e.g., such that intake 212 and exhaust 216 are in fluid communication with each other when door 112 is in the closed position). Channel permits the flow of air to flow through door 112 from intake 212 to exhaust 216. Exhaust 216 may be located at top lip 192 of the door 112, a front surface 196 of door 112, or a combination thereof.

The flow of air through door 112 can assist with limiting or reducing heat transfer along the transverse direction T (e.g., during operation of bottom or top heating elements and of oven range appliance). As an example, an inner surface (also referred to as a rear surface 198) of door 112 faces and is positioned adjacent internal chamber 116 of cabinet 114 when door 112 is in the closed position. Conversely, an outer surface (also referred to as a front surface 196) of door 112 is positioned opposite inner surface of door 112 and faces away from internal chamber 116 of cabinet 114 when door 112 is in the closed position. The flow of air can be cool relative to the inner surface of door 112 such that the flow of air limits or reduces heat transfer between the inner surface of door 112 and the outer surface of door 112 during operation of bottom or top heating elements and of oven range appliance (e.g., such that the outer surface of door 112 is cool relative to the inner surface of door 112). In such a manner, the outer surface of door 112 can be insulated.

In some embodiments, oven appliance 100 includes a drawer 220 movably mounted to cabinet 114. For instance, drawer 220 may be slidably mounted to cabinet 114 to selectively move forward/rearward along the transverse direction T. One or more slidable rails, bearings, or assemblies 222 may be installed or mounted between drawer 220 and cabinet 114 to facilitate movement of drawer 220 relative to cabinet 114, as would be understood. As shown, drawer 220 may be disposed generally below internal chamber 116. In particular, drawer 220 may be disposed below door 112. Generally, drawer 220 is disposed between left panel 142 and right panel 144 (e.g., along the lateral direction L) Optionally, drawer 220 may be disposed above bottom panel 140. Alternatively, drawer 220 may be disposed below bottom panel 140 (e.g., such that an open cavity or recess is defined between panels below bottom panel 140 to receive drawer 220).

Oven appliance 100 is further equipped with a controller 162 to regulate operation of the oven appliance 100. For example, controller 162 may regulate the operation of oven appliance 100, including activation of heating elements as well as heating assemblies 166 generally. Controller 162 may be in operable communication (e.g., via a suitable electronic wired connection) with the heating elements and other components of the oven appliance 100, as discussed herein. In general, controller 162 may be operable to configure the oven appliance 100 (and various components thereof) for cooking. Such configuration may be based on a plurality of cooking factors of a selected operating cycles, sensor feedback, etc.

By way of example, controller 162 may include one or more memory devices (e.g., non-transitive media) and one or more microprocessors, such as general or special purpose microprocessors operable to execute programming instructions or micro-control code associated with an operating cycle. The memory may represent random access memory such as DRAM or read only memory such as ROM or FLASH. In exemplary embodiments, the processor executes programming instructions stored in memory. The memory may be a separate component from the processor or may be included onboard within the processor.

Controller 162 may be positioned in a variety of locations throughout oven appliance 100. For instance, controller 162 may be located within a user interface panel (also referred to as control panel 174) of oven appliance 100, as shown in FIG. 2. In some such embodiments, input/output ("I/O") signals may be routed between the control system and various operational components of oven appliance 100 along wiring harnesses that may be routed through cabinet 114. In some embodiments, controller 162 is in operable communication (e.g., electronic or wireless communication) with user interface panel and controls 164, through which a user may select various operational features and modes and monitor progress of oven appliance 100. In optional embodiments, user interface panel may represent a general purpose I/O ("GPIO") device or functional block. In certain embodiments, user interface panel includes input components or controls 164, such as one or more of a variety of electrical, mechanical, or electro-mechanical input devices including rotary dials, push buttons, and touch pads. Additionally or alternatively, user interface panel may include a display component, such as a digital or analog display device designed to provide operational feedback to a user. User interface panel may be in operable communication with controller 162 via one or more signal lines or shared communication busses.

Furthermore, the user interface panel (e.g., control panel 174) is located within convenient reach of a user of appliance. User interface panel includes various input components, such as one or more of a variety of touch-type controls 164, electrical, mechanical, or electro-mechanical input devices including knobs, rotary dials, push buttons, and touch pads. The user interface panel may include a display component, such as a digital or analog display device, designed to provide operational feedback to a user.

Various appliance features of appliance may be activated/deactivated by a user manipulating the input components on user interface panel. Thus, for example, when appliance is a cooktop 186 or oven appliance 100, a user may manipulate knobs or buttons on user interface panel to activate and deactivate heating elements of the appliance. As another example, a user of appliance may set a timer on user interface panel.

Figure 3:
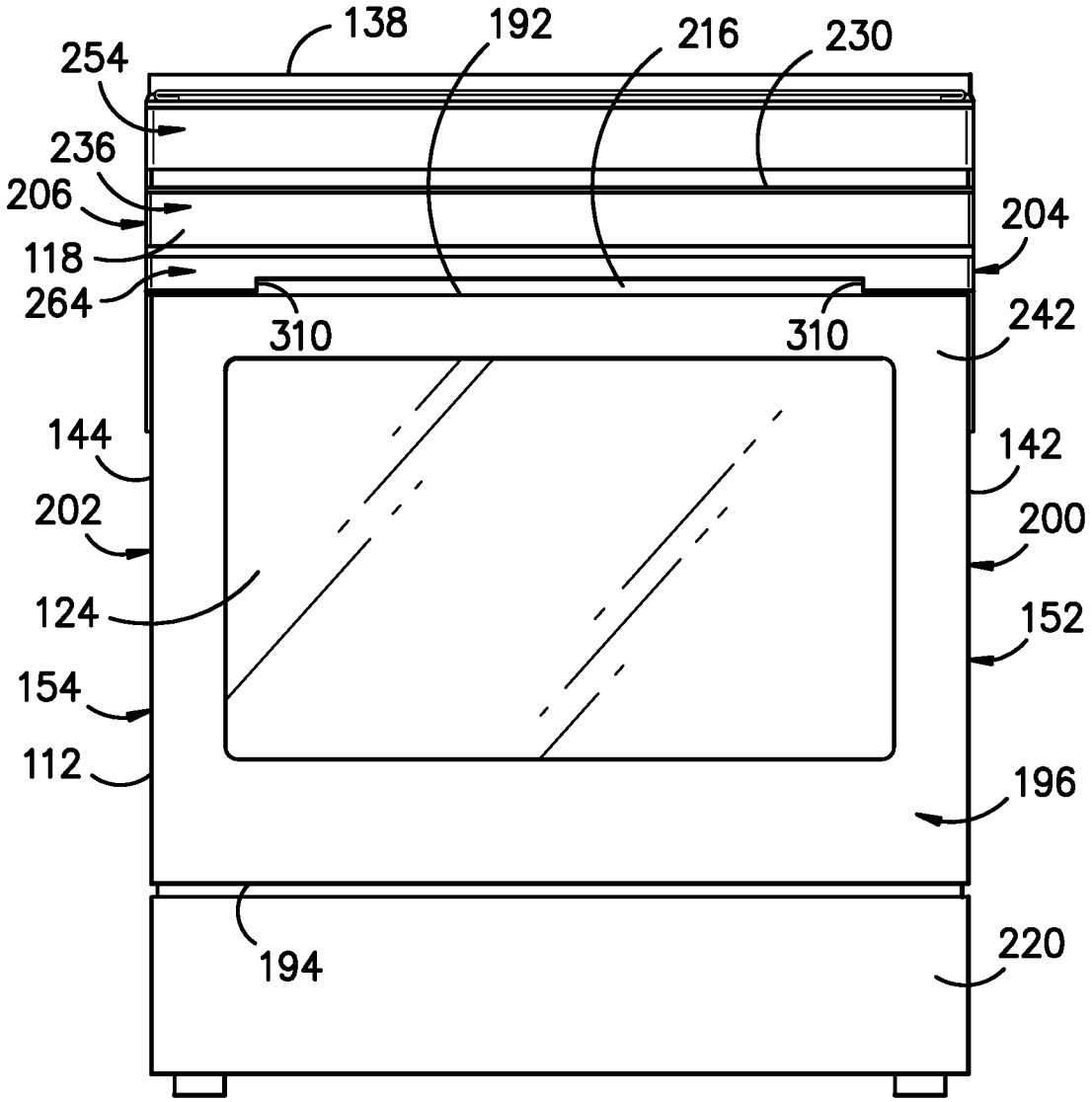
FIG. 3 provides a front view of the exemplary household appliance of FIG. 1.

Turning to FIGS. 2 and 3, the door 112 may be mounted onto cabinet 114 below the front panel 156 to selectively restrict access to the internal chamber 116 in the closed position. As noted above, the handle 118 may be provided on the door 112 proximal to the top lip 192 of the door 112 and distal to the bottom lip 194 of the door 112. For instance, the handle 118 may be positioned at or adjacent the top lip 192 of door 112. In some embodiments, the handle 118 generally extends along the transverse direction (e.g., forward from a front surface 196 of the door 112) between a forward surface 236 and a rearward surface 234 and along the lateral direction (e.g., between opposing surfaces 200, 202 of the door 112) between a first lateral side 204 and a second lateral side 206 (for example, left endcap outer surface 358L and right endcap outer surface 358R). Once assembled, the handle 118 may be readily engaged or grasped by a user, such as to aid a user in accessing the internal chamber 116.

In certain embodiments, the handle 118 extends forward from the front surface 196 at a handle 118 angle with respect to the vertical direction. In some examples, the handle angle 224 is an acute angle. The handle angle 224 ascends away from the cabinet 114, particularly ascending away from the top lip 192 of the door 112. In some further examples, the handle angle 224 is maintained for the entire lateral length of the handle 118. The handle angle 224 may be parallel to an underside angle 168 of the underside surface 150 of the top panel 138. A proximal transverse upper edge 228 of the handle 118 is located transversely inward compared to a distal transverse upper edge 230 of the handle 118, and the proximal transverse upper edge 228 is vertically lower than the distal transverse upper edge 230. The distal transverse upper edge 230 may include or be formed as the edge located vertically topmost on the handle 118. The handle angle 224 is formed by the upper surface 210, ascending such that the proximal transverse upper edge 228 of the upper surface 210 is vertically lower and transversely inward towards the inner cavity 136 of the oven appliance 100 than the distal transverse upper edge 230 of the upper surface 210 of the handle 118. The handle angle 224 may generally match the underside angle 168 of the top panel 138. Thus, the underside angle 168 may be complementary to the handle angle 224. The upper handle 118 panel extends parallel to the underside panel 160 along the lateral direction, forming parallel planes angled vertically and having transverse depth. In some examples, the handle angle 224 is between and degrees with respect to the vertical direction.

Generally, the handle 118 defines a handle thickness 232 between a forward surface 236 and a rearward surface 234. The forward surface 236 extends the lateral length of the handle 118 and extends generally vertically up and down. The forward surface 236 is the protuberant surface of the handle 118. The forward surface 236 extends vertically downward from the distal transverse upper edge 230 of the handle 118 and vertically downward from the upper surface of the handle 118.

The rearward surface 234 extends the lateral length of the handle 118 and may further extend vertically (e.g., along or substantially parallel to the vertical direction V). The rearward surface 234 is the surface of the handle 118 that faces the forward panel 148 of the cabinet when the door 112 is in the upright, closed position. In some embodiments, the rearward surface 234 extends vertically downward from the proximal transverse upper edge 228 of the handle 118, the proximal transverse upper edge 228 also defining an edge of the upper surface 210 of the handle 118. As shown, the rearward surface 234 may generally be on the same plane as or parallel to the plane of the rear surface 198 of the door 112.

In certain embodiments, the handle 118 extends beyond the door 112 thickness. The handle thickness 232 extends forward of the front surface 196 of the door 112 (e.g., in the transverse direction T). Though the handle angle 224 may extend the handle 118 at a non-orthogonal direction with respect to the vertical direction V, the handle thickness 232 is a transverse length, the thickness being the transverse distance between the forward surface 236 of the handle 118 and the rearward surface 234 of the handle 118. Thus, the handle 118 may have a greater thickness than the door 112. In some examples, a handle thickness 232 extends between and times the door 112 thickness.

The upper surface 210 of the handle 118 is directed substantially vertically upward. As shown, the upper surface 210 may extend between the proximal transverse upper edge 228 and the distal transverse upper edge 230. The upper surface 210 faces upward (e.g., away from the top lip 192), opposite to the bottom lip 194 of the door 112. The upper surface 210 is distal from the door 112, such as the most vertically distal surface of the handle 118 to the top lip 192 of the door 112. The upper surface 210 also extends laterally between a pair of upper lateral sides 240. In some examples, the upper surface 210 of the handle 118 extends the full lateral length of the door 112, with the pair of upper lateral sides 240 laterally aligning with the first lateral surface 200 and the second lateral surface 202 of the door 112. The upper surface 210 of the handle 118 may further extend the length of the forward panel 148 of the cabinet. Additionally or alternatively, the upper surface 210 of the handle 118 may extend the lateral length of the top panel 138. Further additionally or alternatively, the upper surface 210 may extend nonorthogonally relative to both the vertical direction and tangential direction from the front surface of the door 112 and from the top lip 192 of the door 112.

In exemplary embodiments, the upper surface 210 is complementary or matched to the underside surface 150 of the top panel 138. The upper surface 210 may be smooth and flat. For instance, the upper surface 210 may extend linearly between the proximal transverse upper edge 228 and the distal transverse upper edge 230. In some embodiments, the upper surface 210 extends along a curved (e.g., nonplanar or nonlinear) path between the proximal transverse upper edge 228 and the distal transverse upper edge 230.

In exemplary embodiments, handle 118 is on the upper vertical portion 242 of the front surface of the door 112. For instance, handle 118 may be proximal to the exhaust 216. The handle 118 may be vertically above the exhaust 216, with a portion of the handle 118 extending forward transversely of the exhaust 216. The handle 118 may further be distal to the window 124 (e.g., in comparison to the top lip 192). Optionally, handle 118 may be vertically above the window 124 of the door 112 when the door 112 is in the closed position.

Figure 4:
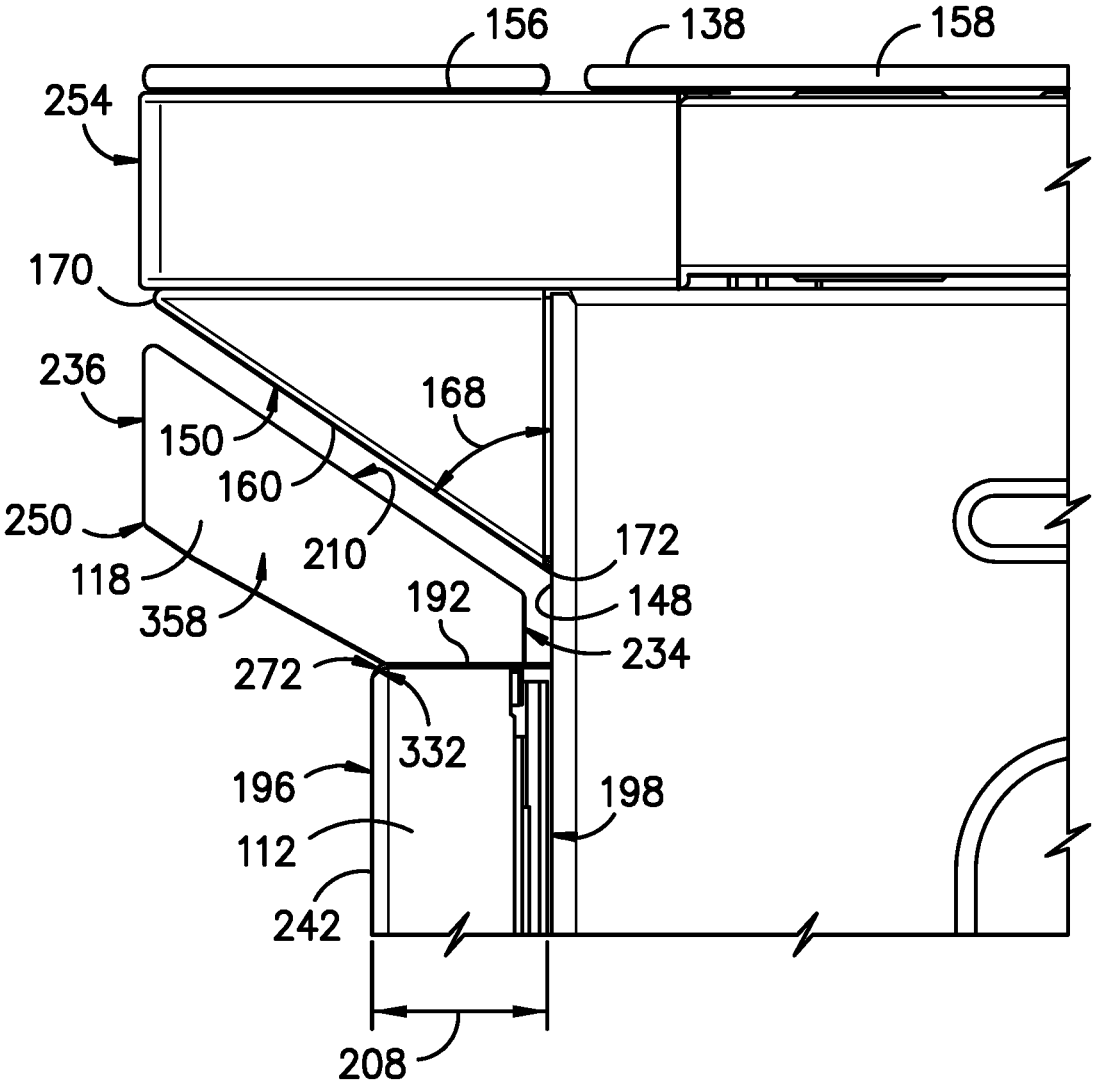
FIG. 4 provides a side view of an exemplary handle and exemplary top panel of the household appliance of FIG. 1.
Figure 5:
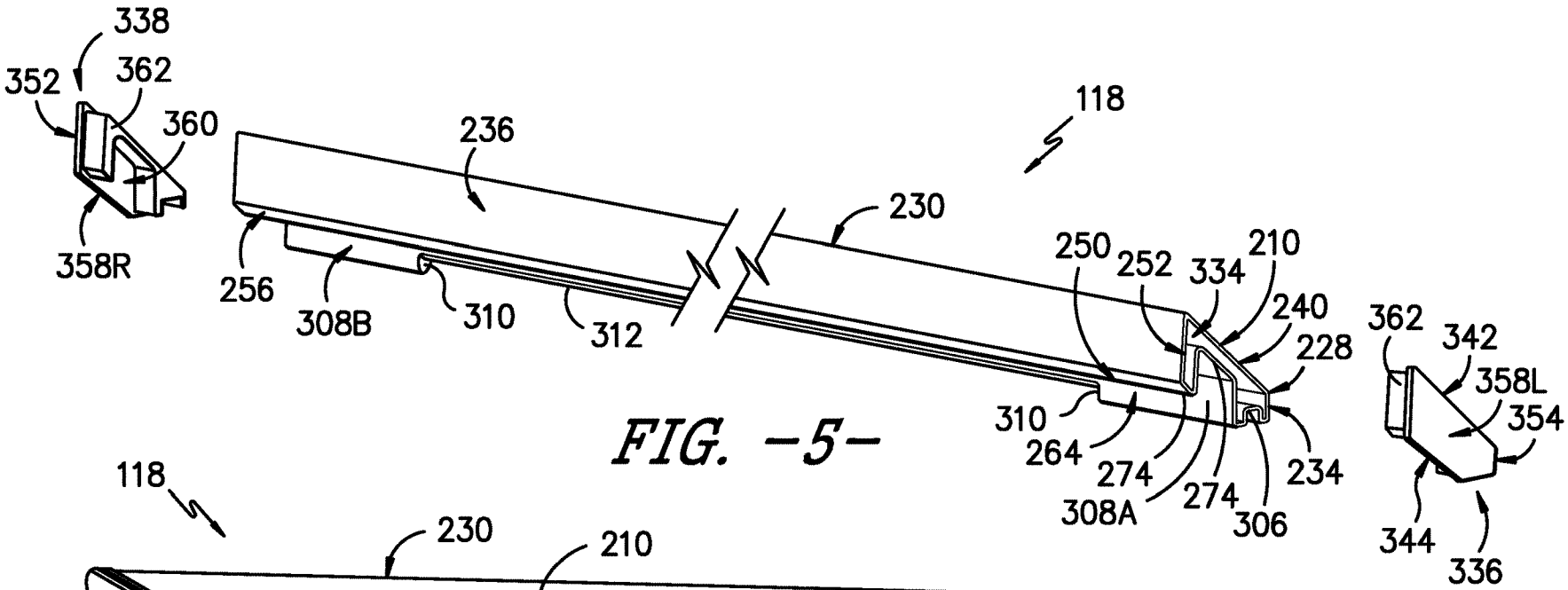
FIG. 5 provides a perspective view of an exemplary handle and exploded related parts will be further described.
Figure 7:
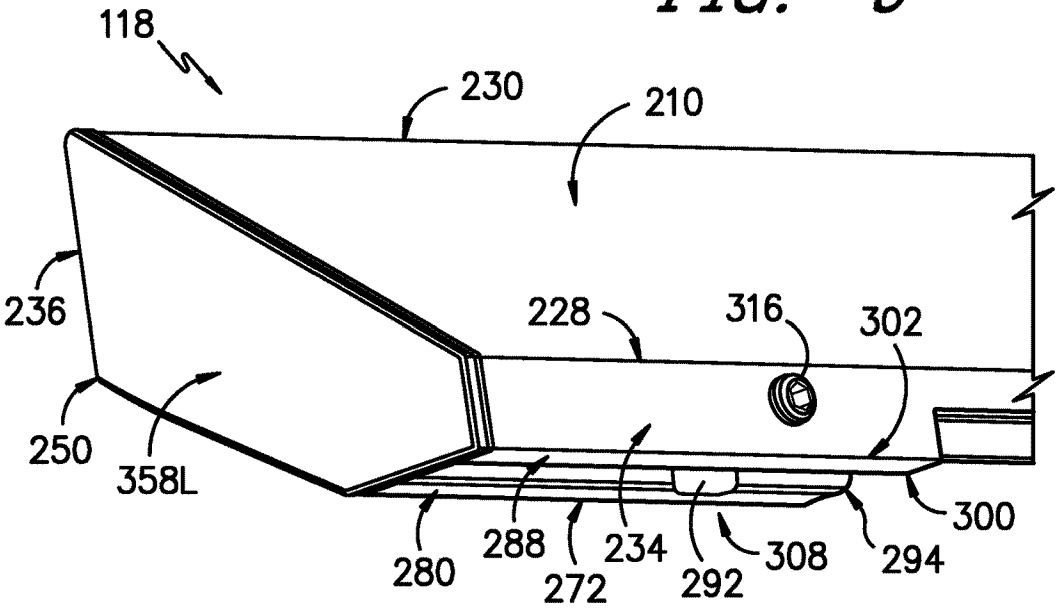
FIG. 7 provides a back perspective view of an exemplary handle of the present disclosure.
Figure 6:
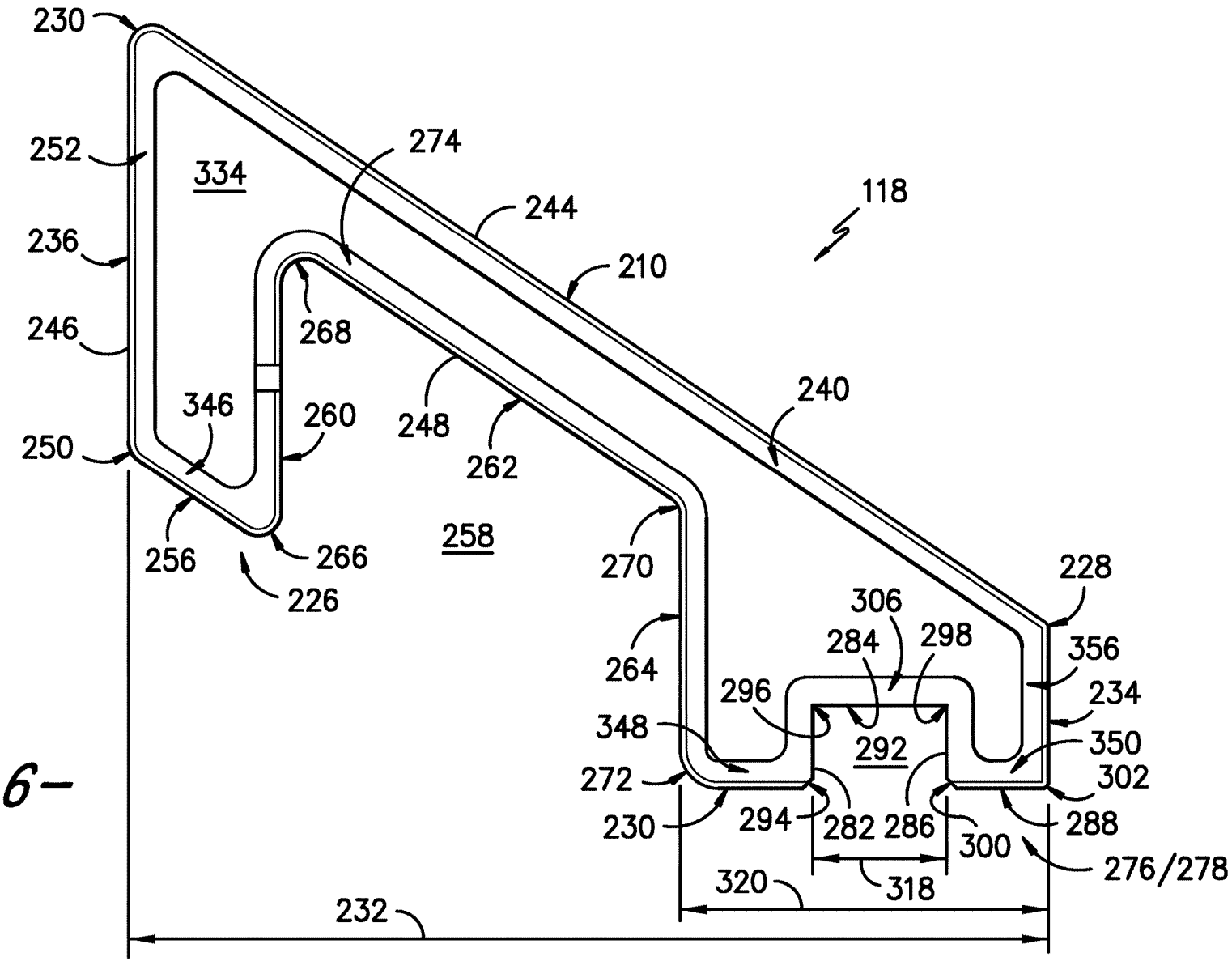
FIG. 6 provides a side, cross sectional view of an exemplary handle of the present disclosure.

Turning to FIGS. 4 through 6, the handle 118 includes a first section 244, a second section 246, and a third section 248. Each section is understood to be a discrete segment of the cross sectional profile for the handle 118 taken along a plane perpendicular to the lateral direction. Each section may have surfaces or sides facing multiple directions (e.g., vertically, transversely, etc.). Surfaces and sides may be used interchangeably herein, but sides are generally understood to be internal structures, not viewed when the appliance is in use, and surfaces are generally understood to be external structures (e.g., which may be visible during use of the appliance). Each section may further include one or more surfaces of the handle 118.

The first section 244 includes the upper portion of the handle 118. For instance, the first section 244 may define the upper surface 210 and extend upward at handle angle 224 relative to the vertical direction from the top lip 192 of the door 112. The first section 244 may also include the pair of upper lateral sides 240, described above. In certain embodiments, the first section 244 extends upward at an acute angle relative to the vertical direction from the top lip 192 of the door 112. The first section 244 (e.g., at the upper surface 210) conforms to the underside surface 150 of the top panel 138 of the oven appliance 100. Thus, the underside surface 150 of the top panel 138 and the upper surface 210 of the handle 118 may be parallel surfaces, each surface having curves or lines approximately normal to corresponding curves or lines along of each of the upper surface 210 and the underside surface 150 of the top panel 138.

The second section 246 extends downward from the first section 244 beyond the front surface 196 of the door 112. For instance, the second section 246 of the handle 118 may include the forward surface 236 of the handle 118 and extends forward from the first section 244 in the transverse direction. The second section 246 may also extend forward from or beyond the front surface 196 of the door 112 (e.g., in the closed position). In some embodiments, the forward surface 236 is located vertically down from the distal transverse upper edge 230. A distal transverse lower edge 250 and the distal transverse upper edge 230 form the vertical edges of the forward surface 236 of the handle 118. The forward surface 236 may be the frontmost surface of the handle 118, extending forward from the other sections of the handle 118. The forward surface 236 may be a substantially vertical surface or substantially parallel with the front surface 196 of the door 112.

A pair of forward lateral sides 252 may extend transversely from lateral ends of the forward surface 236. In turn, the second section 246 of the handle 118 may include the pair of forward lateral sides 252.

In some examples, the second section 246 is roughly orthogonal to the top panel of the oven appliance 100. In some examples, the second section 246 protrudes from the front surface 196 of the door 112, aligning vertically with a frontmost transverse surface 254 of the top panel 138 of the appliance. In some examples, the frontmost transverse surface of the top panel 138 is further the frontmost transverse surface 254 of the front surface 196. In some examples, the second section 246 extends beyond the front surface 196 of the door 112 but does not extend beyond the frontmost transverse surface 254 of the front surface 196.

The third section 248 of the handle 118 extends behind the second section 246. Additionally or alternatively, the third section 248 may be disposed vertically underneath the first section 244. The third section 248 extends transversely behind the second section 246. The handle 118 may be hollow, allowing for a space between the first section 244 and the third section 248. The second section 246 connects the first section 244 to the third section 248. The sections may be discrete panels or may be formed as a uniform (e.g., integral, unitary, or monolithic) body.

The third section 248 includes an underside forward surface 256. The underside forward surface 256 extends behind the distal transverse lower edge of the forward surface 236. The underside forward surface 256 is underneath the upper surface 210. The underside forward surface 256 and the upper surface 210 may be parallel surfaces.

In some embodiments, the handle 118 defines a pocket grip 226 beneath the upper surface 210. The pocket grip 226 may be contoured to allow a hand to grasp the handle 118. For instance, the third section 248 of the handle 118 may extend behind the second section 246 to allow a user to grasp the handle 118 at a pocket grip 226 formed or defined by the second section 246 and third section 248. In some embodiments, the third section 248 includes a set of surfaces forming a pocket grip handle cavity 258. The set of surfaces forming the pocket grip handle cavity 258 may include an underside forward vertical surface 260, an underside pocket surface 262, or an underside rear vertical surface 264. The underside forward vertical surface 260 and the underside rear vertical surface 264 may face each other, the underside forward vertical surface 260 transversely being disposed in front of the underside rear vertical surface 264. The underside forward vertical surface 260 is transversely behind the underside forward surface 256. The underside forward vertical surface 260 may also be parallel to the underside forward surface 256.

The underside forward vertical surface 260 extends vertically upward from a rear forward edge 266 of the underside forward surface 256. The underside pocket surface 262 faces generally vertically downward and may be generally parallel to the upper surface 210. The underside pocket surface 262 may be above the underside forward surface 256. The underside forward vertical surface 260 may be attached to the underside pocket surface 262 at an inner distal edge 268, the inner distal edge 268 forming a vertical edge of the underside forward vertical surface 260.

The underside pocket surface 262 extends between the inner distal edge 268 and an inner proximal edge 270, the inner proximal edge 270 being disposed transversely closer to the front surface 196 of the door 112 compared to the inner distal edge 268. The underside pocket surface 262 may be parallel with the upper surface 210. The underside pocket surface 262 may further be parallel with the underside forward surface 256. The underside pocket surface 262 may be disposed vertically in between the upper surface 210 and the underside forward surface 256. The underside pocket surface 262 is transversely behind the underside forward surface 256.

Moving further proximal to the front surface 196 of the door 112, the underside rear vertical surface 264 may be attached to the underside pocket surface 262 at the inner proximal edge 270. The underside rear vertical surface 264 may be substantially parallel to the underside forward vertical surface 260. A lower underside edge 272 may define a lower vertical edge of the underside rear vertical surface 264. The inner proximal edge 270 may define an upper vertical edge of the underside rear vertical surface 264.

The underside pocket surface 262 may be above both the underside rear vertical surface 264 and the underside forward vertical surface 260. These three surfaces may form or define a pocket grip handle cavity 258 with a cross sectional shape generally forming an upside down U. The pocket grip handle cavity 258 may extend the lateral length of the handle 118. The third section 248 may form or include the underside of the pocket grip 226, and the second section 246 may form a front portion of the pocket grip 226.

The third section 248 may also include lower lateral sides 274. Lower lateral sides 274 may extend vertically and transversely along the lateral ends of the surfaces included in the third section 248.

Turning especially to FIG. 6, the handle 118 further includes a door connection 276. The door connection 276 may comprise a fourth section 278 of the handle 118. In some such embodiments, the door connection 276 is disposed transversely behind the third section 248. The door connection 276 may include several surfaces including a front fastening surface 280, a front fastening vertical surface 282, a pocket fastening surface 284, a rear fastening vertical surface 286, a rear fastening surface 286, or a rearward surface 234. Each surface will be described in more detail below. The forwardmost surface of the door connection 276 may be the front fastening surface 280, which is attached to the underside rear vertical surface 264 at the lower underside edge 272. In certain embodiments, the front fastening surface 280 faces vertically downward and extends in the transverse and lateral directions along the length of the handle 118. The front fastening surface 280 may further face the upper lip of the door 112.

In exemplary embodiments, the fourth section 278 defines an attachment cavity 292. The front fastening vertical surface 282, pocket fastening surface 284 and rear vertical surface may all define the attachment cavity 292. The front fastening vertical surface 282 may extend vertically into the handle 118 and attach to the front fastening surface 280 at an outer forward edge 294. The outer forward edge 294 may be the rear transverse edge of the front fastening surface 280. The front fastening vertical surface 282 may attach to the pocket fastening surface 284 at an inner forward edge 296. The inner forward edge 296 may be the upper vertical edge of the front fastening vertical surface 282. The pocket fastening surface 284 may extend transversely behind the front fastening vertical edge. The pocket fastening surface 284 may be roughly orthogonal to the front fastening vertical surface 282. Additionally or alternatively, the pocket fastening surface 284 may be disposed further vertically above and transversely behind the front fastening surface. The rear fastening vertical surface 286 extends laterally and transversely and may be attached to the pocket fastening surface 284 at an inner rear edge 298. The rear fastening vertical surface 286 may face the front fastening vertical surface 282. In some embodiments, the rear fastening vertical surface 286 is parallel to the front fastening vertical surface 282. The rear fastening vertical surface 286 has an upper edge at the inner rear edge 298 and a lower vertical edge at an outer rear edge 300. The pocket fastening surface 284 is vertically above the front fastening vertical surface 282 and the rear fastening vertical surface 286. The rear fastening vertical surface 286 may be substantially orthogonal to the pocket fastening surface 284. Hence, the attachment cavity 292 may extend vertically upward into the handle 118.

The door connection 276 further extends vertically downward from the first section 244. A rearward surface 234 attaches to the upper surface 210 at proximal transverse upper edge 228, which may define the upper edge of the rearward surface 234. The rearward surface 234 may be the surface transversely closest to the forward panel 148 of the cabinet. A proximal lower edge 304 and proximal transverse upper edge 228 may be the vertical edges of the rearward surface 234. In some embodiments, the rearward surface 234 is orthogonal to a rear fastening surface 286. The rear fastening surface 286 may be attached to the rearward surface 234 at the lower proximal edge. The rear fastening surface 286 may be on the same horizontal plane as the front fastening surface 280. The rear fastening surface 286 may be attached to the rear fastening vertical surface 286 at the outer rear edge 300. As shown, some or all of the described door connection 276 surfaces may be disposed vertically below the upper surface 210, as the lowest edge of the upper surface 210.

The door connection 276 or fourth section 278 may further include a set of lateral fastening sides 306. Each lateral fastening side 306 may correspond to a lateral edge of each of the surfaces included in the door connection 276.

Turning to FIGS. 7 through 11, the attachment cavity 292 extends vertically upward into the bottom of the handle 118. A first fastener 314 may extend into the attachment cavity 292. In some embodiments, the rearward surface 234 includes a fastening opening. A second fastener 316 may be placed through the rearward surface 234 at the fastening opening and attach to the first fastener 314. The first fastener 314 and second fastener 316 may thereby attach the handle 118 to the door 112. The first fastener 314 and second fastener 316 are described in more detail below.

In some examples, the handle 118 may further include a fastener (e.g., second fastener 316) extending from the handle 118 (e.g., upper surface 210 or rearward surface 234) to an upper portion of the door 112 (e.g., the top lip 192, the upper vertical portion 242 or the upper vertical portion 324) to permit selective removal of the handle 118 from the door 112 such that the handle 118 is removable by way of the fastener. Some examples may include at least two fasteners, extending from the surface of the handle 118 to an upper portion of the door 112, at discrete lateral positions 322 (e.g., first discrete lateral position 368, second discrete lateral position 370, or discrete lateral front positions 376).

In some examples, the door connection 276 has a lateral length equal to the length of the door 112. In certain examples, the door connection 276 only extends a portion of the length of the door 112. In further examples, the door connection 276 includes a set of attachment cavity sections 308 as shown in FIG. 5. Each attachment cavity section 308A may be along the same transverse plane as the other attachment cavity section 308B. Each attachment cavity section 308A, 308B may have a corresponding attachment cavity 292. Each attachment cavity 292 may be formed by the surfaces included in the door 112 connection including the front fastening surface 280 the front fastening vertical surface 282, the pocket fastening surface 284, the rear fastening vertical surface 286, and the rear fastening surface 286. These surfaces may extend along a portion of the underside of the handle 118. These surfaces may further begin at lateral ends and move inward laterally. Each attachment cavity section 308A, 308B may end at an inward lateral position 310. In between the pair of attachment cavity sections 308A, 308B, a bottom surface 312 may extend laterally. The bottom surface 312 may extend transversely between the lower underside edge 272 and the proximal lower edge 304. The bottom surface 312 may be vertically above the front fastening surface 280.

Figure 8:
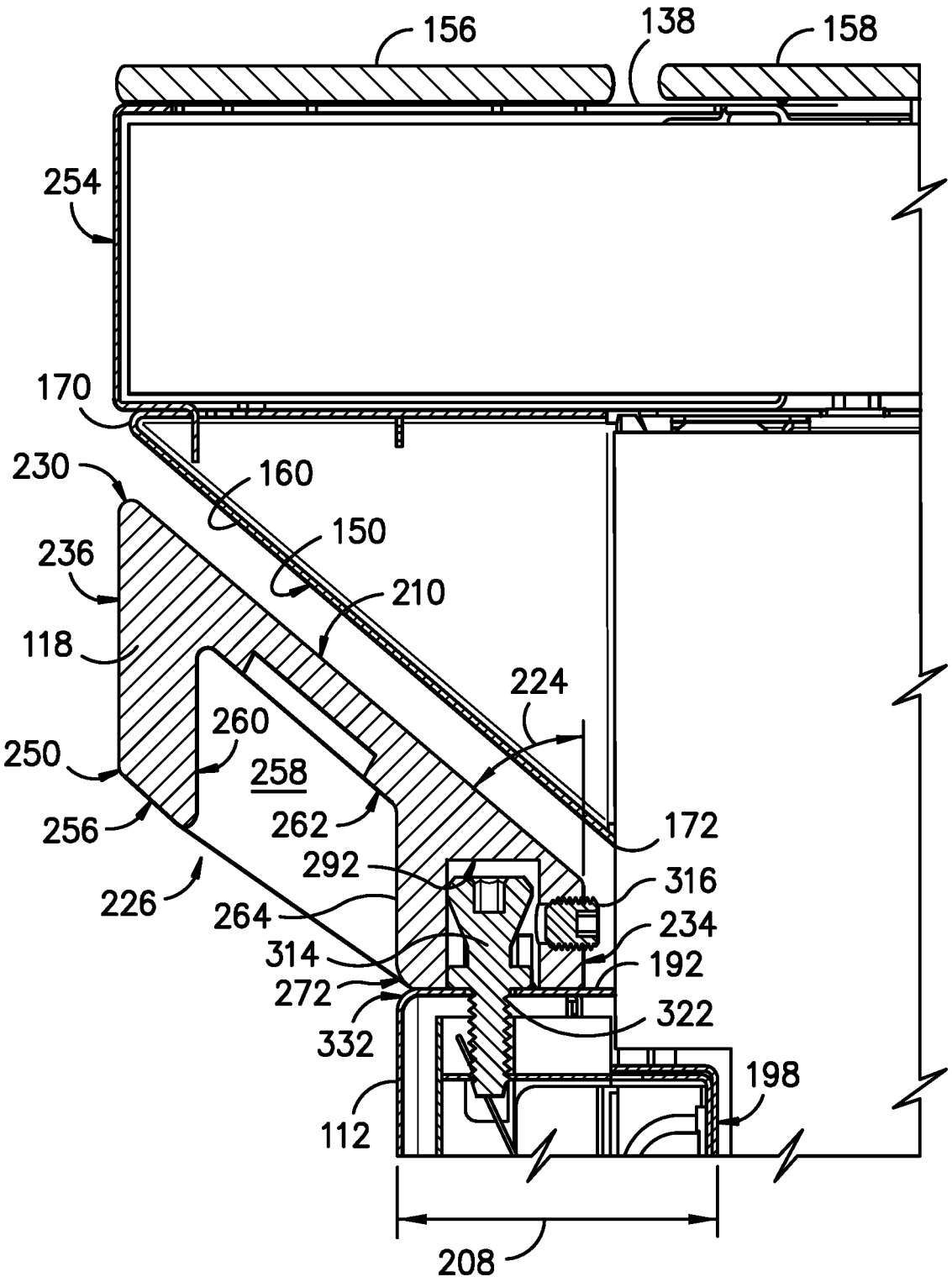
FIG. 8 provides a side, cross sectional view of an exemplary handle and exemplary top panel of the household appliance of FIG. 1.

Generally, the door connection 276 has an inner cavity width 318 extending between the front fastening vertical surface 282 and the rear fastening vertical surface 286. As shown in FIG. 8, the inner cavity width 318 may be less than the door 112 thickness. Additionally or alternatively, a door connection width 320 from the underside rear vertical surface 264 to the rearward surface 234 (in the transverse direction) may be larger than the inner cavity width 318 and may be less than the door 112 thickness.

Figure 10:
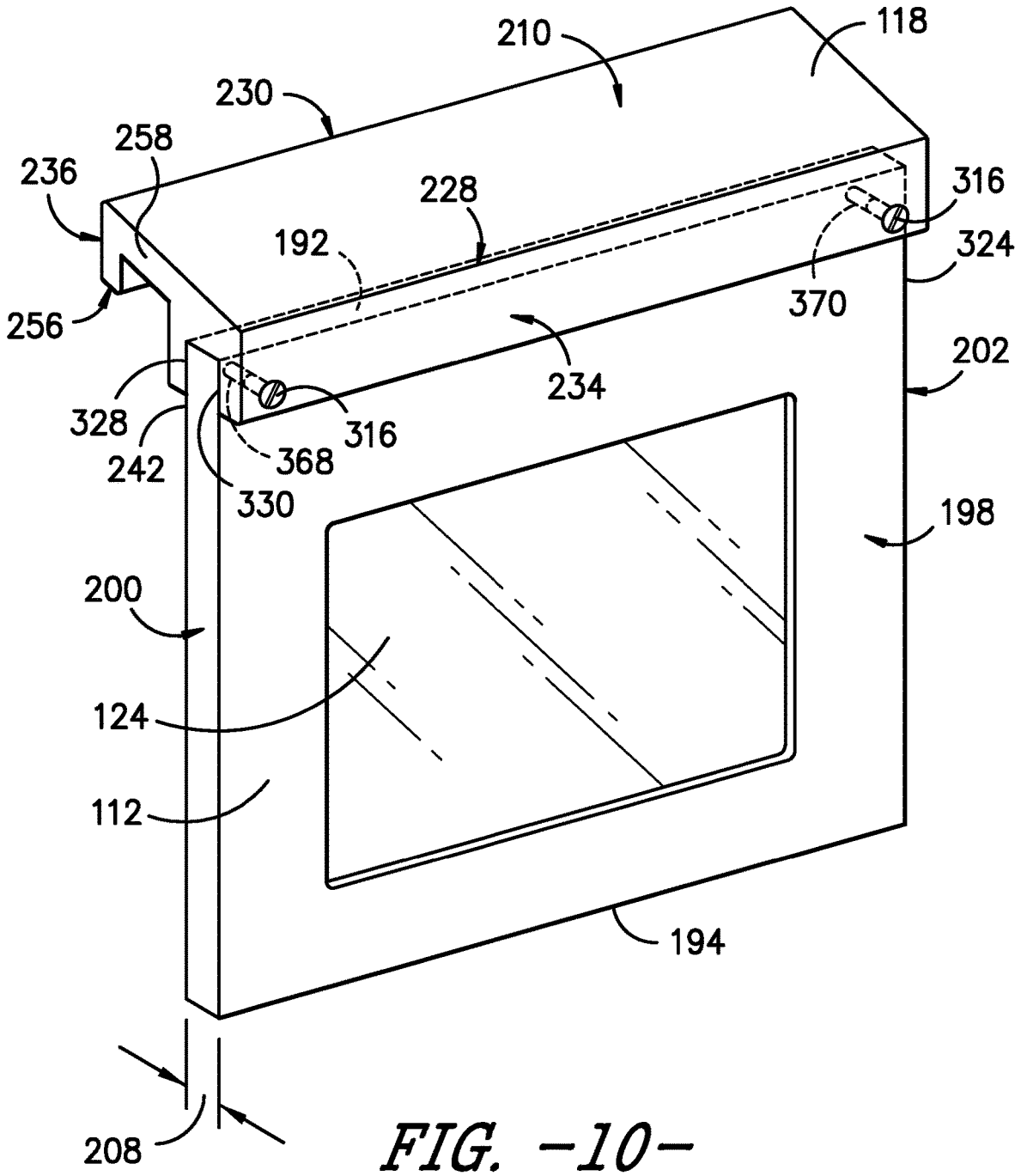
FIG. 10 provides a rear perspective view of an exemplary handle and door of the present disclosure.

In some examples, the door connection 276 has an inner cavity width 318 that is wider than or equal to the door 112 thickness, as shown in FIG. 10. When assembled, the door connection 276 may cover the top lip 192. In some examples, the door connection 276 covers the top lip 192 and an upper vertical portion of a front surface 196 of the door 112 and an upper vertical portion of a rear surface 198 of the door 112. The handle 118 may further include a fastener (e.g., second fastener 316) extending from the handle 118 to an upper portion of the door 112 to permit selective removal of the handle 118 from the door 112 such that the handle 118 is removable by way of the fastener. A second fastener 316 alone may be used to attach the handle 118 to the door 112 in these examples, the second fastener 316 extending through the rearward surface 234, into the attachment cavity $\mathbf{388}_A$ or $\mathbf{388}_B$, and into the rear surface 198 of the door 112. In some examples, two or more second fasteners 316 may be used to attach the handle 118 to the door 112, each second fastener 316 provided at discrete lateral positions 322 along the handle 118 and the door 112. There may be one discrete lateral position 322 for each second fastener 316 provided to the handle 118 and the door 112.

Additionally or alternatively, as shown in FIG. 10, the door connection 276 may cover an upper vertical portion 242 of a front surface 196 of the door 112 and an upper vertical portion 324 of a rear surface 198 of the door 112. The door connection 276 may thus extend over the top lip 192 of the door 112, and onto a top portion 328 of the front surface of the door 112 and a top portion 330 of the rear surface of the door 112.

In some examples, the door connection 276 has an inner cavity width 318 that is less wide than the door 112 thickness. The lower underside edge 272 is flush with a front transverse edge 332 of the top lip 192 of the door 112, and the underside rear vertical surface 264 of the third section 248 is flush with the front surface 196 of the door 112. The rearward surface 234 may be transversely in between the front surface 196 of the door 112 and the rear surface 198 of the door 112, as shown in FIG. 8. In certain examples, the rearward surface 234 may be flush with the rear surface 198 of the door 112.

The surfaces of the first section 244, second section 246, third section 248 and fourth section 278 are described as separate surfaces for ease in description herein but may include a uniform piece in some embodiments. Additionally or alternatively, the surfaces of the first section 244, second section 246, third section 248 and fourth section 278 further define an inner handle cavity 334 that runs laterally through the length or at least a portion of the length of the handle 118.

Turning to FIGS. 5 through 9, the handle 118 includes a set of endcaps 336, 338. For instance, the handle 118 may have two endcaps 336, 338 on opposing lateral sides 152, 154 of the handle 118. There is a left endcap 336 and a right endcap 338. The endcaps 336, 338 attach to the handle 118 at the lateral sides 152, 154 of the handle 118. Each endcap is in contact with a set of lateral sides of the handle 118. For example, first endcap (for example, left endcap 336) is in contact with the first upper lateral side 240, the first forward lateral side 252, the first set of lower lateral side 274, and the first set of lateral fastening sides 306. The second endcap (for example, right endcap 338) in contact with the second upper lateral side 240, the second forward lateral side 252, the second set of lower lateral sides 274, and the second set of lateral fastening sides 306. The endcaps 336, 338 are in contact with the lateral sides of the first section 244, second section 246, third section 248, and fourth section 278 of the handle 118.

In some embodiments, a top edge 342 of each endcap follows each upper lateral side of the first section 244, including extending forward from the front surface 196 of the door 112 at handle angle 224 with the vertical. A bottom edge 344 of each endcap may follow an underside forward lateral side 346 attached to the underside forward surface 256, extending beyond and behind the rear forward edge 266 to the lower underside edge 272, attaching at a front fastening lateral side 348 that is attached to the front fastening surface 280. The bottom edge 344 of each endcap may further extend along the front fastening lateral side 348 extending beyond the outer forward edge 294 to the outer rear edge 300, and along a rear fastening lateral side 350 that is attached to the rear fastening surface 286. A first side edge 352 of the endcap follows the forward lateral side 252. A second side edge of the endcap follows a rearward lateral side 356 that is attached to the rearward surface 234. The top edge 342, bottom edge 344, first side edge 352 and second side edge 354 define the edges of an endcap panel of each endcap.

The endcap panel may have an outer endcap surface 358 facing laterally outward and an inner endcap surface 360 facing laterally inward toward the lateral edges of the handle 118. The endcaps 336, 338 may define lateral sides 152, 154 to the pocket grip handle cavity 258. Each endcap panel may further define the lateral sides 152, 154 of the pocket grip handle cavity 258. Furthermore, each inner endcap surface 360 defines the lateral surfaces that define the pocket grip handle cavity 258. Each endcap extends below the underside pocket surface 262.

Figure 9:
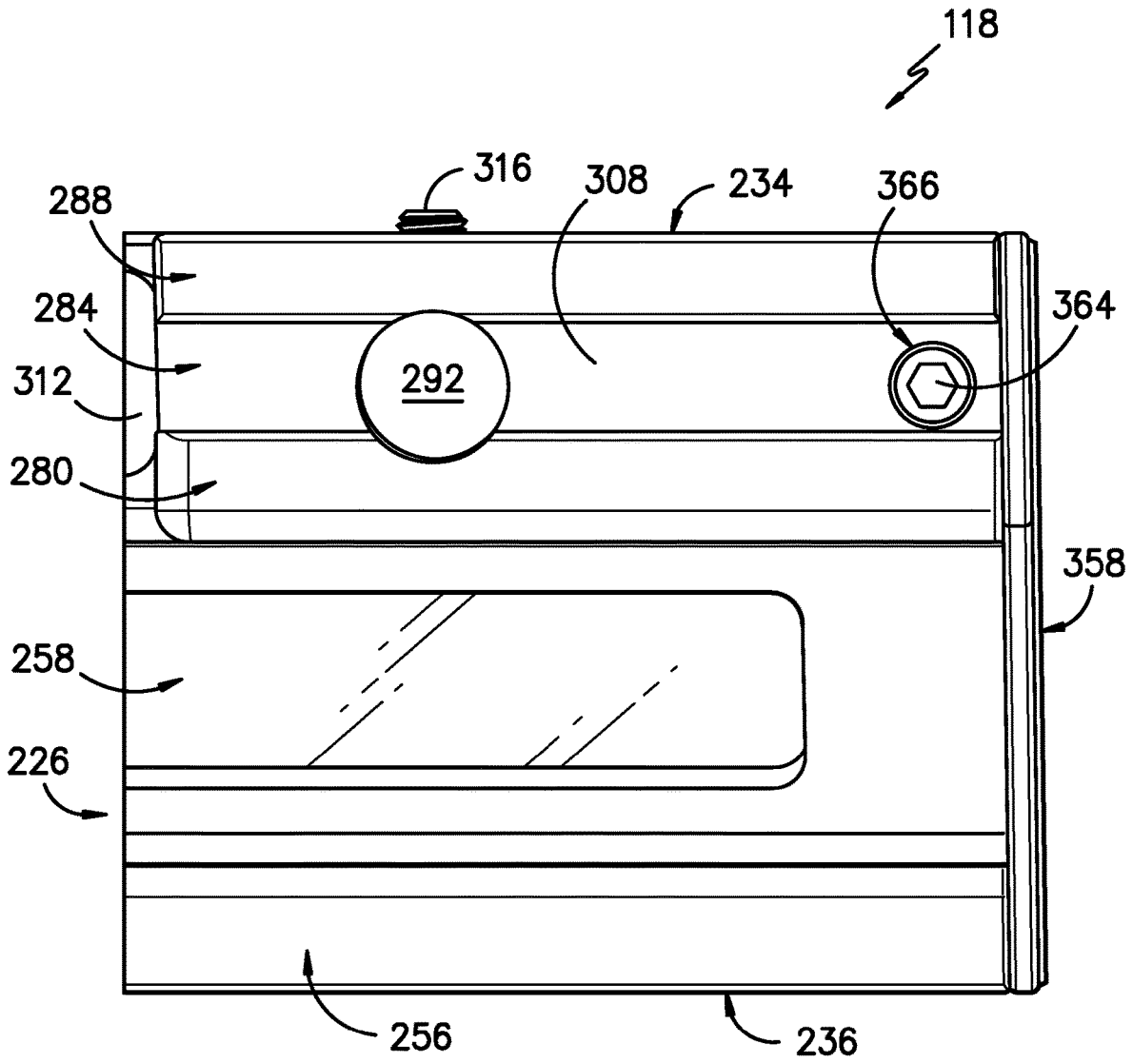
FIG. 9 provides an underside perspective view of an exemplary handle of the present disclosure.

The endcaps 336, 338 may attach to the lateral sides of the handle 118 with clips, snaps, screws, nails, glue, or other appropriate attachments as known in the art. As shown in FIG. 5, each endcap may further include an endcap connection piece 362 extending laterally inward from the endcap panel and shaped to fit into a portion of the inner handle cavity 334. As shown in FIG. 9, each endcap may be attached by at least one endcap fastener 364. Each endcap fastener 364 may comprise a clip, a snap a screw, a nail, a volume of glue, a mated prong, an adhesive, or other appropriate fastener. Endcap fastener 364 may attach the endcap to the handle 118. The endcap fastener 364 may be provided to the endcap surface through an endcap cavity 366 defined on the pocket fastening surface 284. The endcap cavity 366 may be proximal to a lateral end of the handle 118. The endcap fastener 364 may attach to the handle 118 and the endcap, extending into the fourth section 278 of the handle 118.

As previously discussed, the handle 118 attaches to the door 112 by way of at least one fastener, for example, first fastener 314 or second fastener 316. In some examples, at least one set of fasteners (for example, first fastener 314 and second fastener 316) attaches the handle 118 to the door 112. In some examples, each fastener is formed from a set of two or more mated mechanical connectors. For example, an exemplary set of mated mechanical connectors may include the first fastener 314 and the second fastener 316. In some examples, two sets of fasteners attach the handle 118 to the door 112, or a first set of mated mechanical connectors 372 and a second set of mated mechanical connectors 374 attaches the handle 118 to the door 112.

As shown in FIGS. 1 through 4, and 7 through 11, the handle 118 may be further attached to the top lip 192 of the door 112 of the oven appliance 100. The handle 118 may attach to the door 112 at discrete lateral positions on the top lip 192. The discrete lateral positions 322 are spaced apart along the lateral direction of the top lip 192. A set of mated mechanical connectors is provided at each discrete lateral position 322. For example, the first set of mated mechanical connectors comprising the first fastener 314 and second fastener 316, is provided at the first discrete lateral position 322. More specifically, the first fastener 314 is provided at the first discrete lateral position and extends into the door 112. The second fastener 316 is provided through the handle 118 and connects with the first fastener 314, securing the handle 118 to the door 112 at the first discrete lateral position 322.

Figure 11:
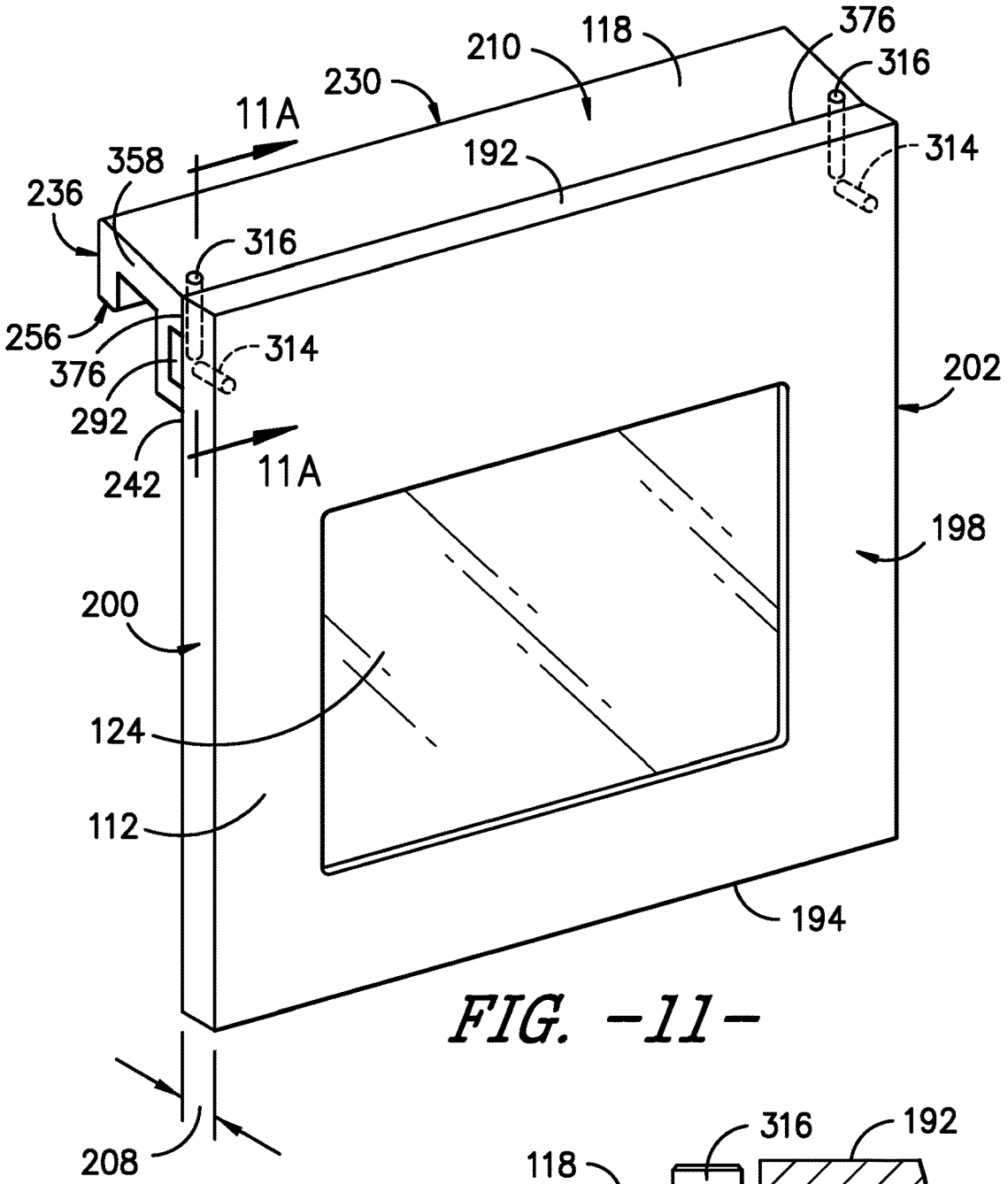
FIG. 11 provides a rear perspective view of an exemplary handle and door of the present disclosure.
Figure 11A:
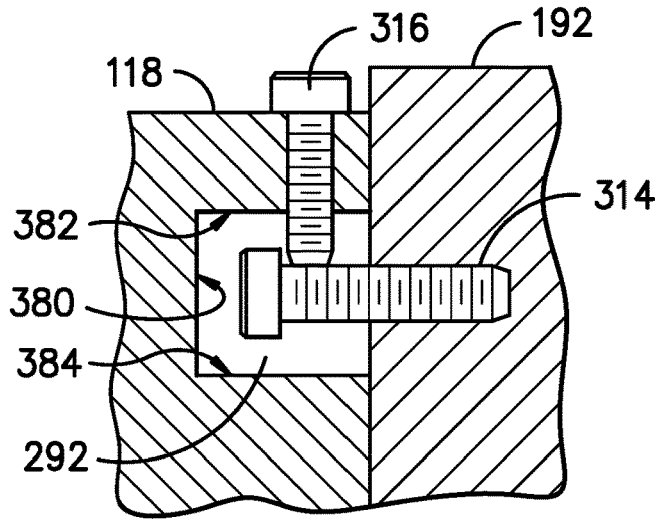
FIG. 11A provides a cross sectional view of the exemplary door and handle of FIG. 11.

In some examples, the handle 118 is further attached to an upper vertical portion 242 of a front surface of the door 112. The handle 118 may attach to the door 112 at discrete lateral front positions on the upper vertical portion 242 of the front surface of door 112. The discrete lateral front positions 322 are spaced apart along the lateral direction of the upper vertical portion 242 of the front surface 196 of the door 112. A set of mated mechanical connectors is provided at each discrete lateral front position 322. For example, if the first set of mated mechanical connectors includes the first fastener 314 and the second fastener 316, the first fastener 314 is provided at the first discrete lateral front position and the second fastener 316 is provided through the handle 118 and connects with the first fastener 314, securing the handle 118 to the door 112. As shown in FIG. 11A, the attachment cavity 292 when the handle 118 attaches to the front surface of the door 112 may be defined by a forward transverse surface 380, a vertical top surface 382, and a vertical bottom surface 384, such that the first fastener 314 extends transversely out from the front surface 196 of the door 112.

There may be two or more discrete lateral positions 322 in some examples. The handle 118 connects to the door 112 by way of two or more sets of mated mechanical connectors, one set of mated mechanical connectors for each discrete lateral position 322. If the handle 118 instead attaches to the front surface 196 of the door 112, there may be two or more discrete lateral front positions. If the handle 118 connects to the door 112 by way of two or more sets of mated mechanical connectors, one set of mated mechanical connectors is provided for each discrete lateral front position.

The first fastener 314 may be a set screw. The second fastener 316 may be a mounting stud. In some examples, the handle 118 further includes at least one set screw and at least one mounting stud, the at least one set screw and at least one mounting stud attaching the handle 118 on the top lip 192 of the door 112. In some examples, the handle 118 includes two set screws and two mounting studs.

In certain embodiments, at least one set of fasteners (for example, first fastener 314 and second fastener 316) attach the handle 118 to the door 112 removably. In other words, each set of fasteners permit selective removal of handle 118 from the door 112 such that handle 118 is removable by way of the at least one set of fasteners. The attachment cavity 292 is placed to align with the discrete position of the first fastener 314 affixed to the door 112 and sized such that the first fastener 314 fits into the attachment cavity 292 of the handle 118 to attach the handle 118 to the door 112. The second fastener 316 is sized to mechanically mate with the first fastener 314, attaching the handle 118 to the door 112.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A household appliance extending along a lateral direction between a pair of opposing sides, extending along a transverse direction between a front and a back, and extending along a vertical direction between a top and a bottom, the household appliance comprising:

a cabinet comprising a top panel, the cabinet defining an internal chamber between the top and the bottom, the top panel defining an underside surface directed downward above the internal chamber;

a door mounted on the cabinet below the top panel to selectively restrict access to the internal chamber in a closed position, the door extending along the vertical direction in the closed position between a top lip and a bottom lip; and a handle provided on the door proximal to the top lip, the handle defining an upper surface directed away from the top lip, the upper surface being a complementary match to the underside surface of the top panel, wherein the handle extends forward from a front surface of the door at an acute angle with respect to the vertical direction, and wherein the handle comprises a first section, a second section, and a third section, the first section defining the upper surface and extending upward at the acute angle relative to the vertical direction from the top lip of the door, the second section extending downward from the first section beyond the front surface of the door, and the third section extending behind the second section to allow a user to grasp the handle at a pocket grip formed by the second section and the third section.

2. The household appliance of claim 1, wherein the door defines a door thickness between a front surface and a rear surface, and wherein the handle extends beyond the door thickness.

3. The household appliance of claim 1, wherein the handle further defines an upper surface directed vertically upward and away from the top lip.

4. The household appliance of claim 1, wherein the underside surface of the top panel faces forward at a non-orthogonal angle relative to the transverse direction.

5. The household appliance of claim 4, wherein the top panel comprises a control panel disposed above the underside surface.

6. The household appliance of claim 1, wherein the handle further comprises two endcaps on opposing lateral sides of the handle.

7. The household appliance of claim 1, wherein the handle defines a pocket grip beneath the upper surface.

8. The household appliance of claim 1, wherein the handle is further attached to the top lip of the door of the household appliance.

9. The household appliance of claim 8, wherein the handle further comprises a door connection, the door connection covering the top lip and an upper vertical portion of a front surface of the door and an upper vertical portion of a rear surface of the door.

10. The household appliance of claim 1, wherein the handle further comprises a fastener extending from the handle to an upper portion of the door to permit selective removal of the handle from the door such that the handle is removable by way of the fastener.

11. The household appliance of claim 1, the handle further comprising at least one set screw and at least one mounting stud, the at least one set screw and at least one mounting stud attaching the handle on the top lip of the door.

12. A household appliance extending along a lateral direction between a pair of opposing sides, extending along a transverse direction between a front and a back, and extending along a vertical direction between a top and a bottom, the household appliance comprising:

a cabinet comprising a top panel, the cabinet defining an internal chamber between the top and the bottom, the top panel defining an underside surface directed downward above the internal chamber;

a door mounted on the cabinet below the top panel to selectively restrict access to the internal chamber in a closed position, the door extending along the vertical direction between a top lip and a bottom lip and along the transverse direction between a front surface and a rear surface in the closed position; and a handle provided on the door proximal to the top lip, the handle defining an upper surface directed away from the top lip, the upper surface being a complementary match to the underside surface of the top panel, wherein the handle extends forward from the front surface of the door at an acute angle with respect to the vertical direction, wherein the handle comprises a first section, a second section, and a third section, the first section defining the upper surface and extending upward at the acute angle relative to the vertical direction from the top lip of the door, the second section extending downward from the first section beyond the front surface of the door, and the third section extending behind the second section to allow a user to grasp the handle at a pocket grip formed by the second section and the third section.

13. The household appliance of claim 12, wherein the underside surface of the top panel faces forward at a non-orthogonal angle relative to the transverse direction.

14. The household appliance of claim 12, wherein the handle is further attached to the top lip of the door of the household appliance.

15. The household appliance of claim 12, wherein the handle is further attached to an upper vertical portion of a front surface of the door.

16. A household appliance extending along a lateral direction between a pair of opposing sides, extending along a transverse direction between a front and a back, and extending along a vertical direction between a top and a bottom, the household appliance comprising:

a cabinet comprising a top panel, the cabinet defining an internal chamber between the top and the bottom, the top panel defining an underside surface directed downward above the internal chamber;

a door mounted on the cabinet below the top panel to selectively restrict access to the internal chamber in a closed position, the door extending along the vertical direction between a top lip and a bottom lip and along the transverse direction between a front surface and a rear surface in the closed position; and a handle provided on the door proximal to the top lip, the handle comprising a first section, a second section, and a third section, the first section defining the upper surface and extending upward at an acute angle relative to the vertical direction from the top lip of the door, the second section extending downward from the first section beyond the front surface of the door, and the third section extending behind the second section to allow a user to grasp the handle at a pocket grip formed by the second section and third section.

17. The household appliance of claim 16, wherein the underside surface of the top panel faces forward at a non-orthogonal angle relative to the transverse direction.

18. The household appliance of claim 16, wherein the top panel comprises a control panel disposed above the underside surface.

19. The household appliance of claim 16, wherein the handle defines a pocket grip beneath the upper surface.

20. The household appliance of claim 16, wherein the handle is further attached to the top lip of the door of the household appliance.

* * * * *